US005442927A

United States Patent [19]

Germain

[11] Patent Number: 5,442,927

[45] Date of Patent: Aug. 22, 1995

[54] SELF-CONTAINED DEVICE FOR SUPPLYING WITH ENERGY AN APPARATUS ACTUATED BY A GAS UNDER PRESSURE AND ITS USE IN A FREEZING INSTALLATION

[75] Inventor: Jean-Pierre Germain, Montigny Les Bretonneux, France

[73] Assignee: L'Air Liquide, Societe Anonyme Pour l'Etude et l'Exploitation des Procedes Georges Claude, Paris, France

[21] Appl. No.: 219,348

[22] Filed: Mar. 29, 1994

[30] Foreign Application Priority Data

Apr. 16, 1993 [FR] France ..... 93 04501

[51] Int. Cl.[6] ..... F17C 9/02

[52] U.S. Cl. ..... 62/50.2; 62/51.1

[58] Field of Search ..... 62/50.2, 51.1

[56] References Cited

U.S. PATENT DOCUMENTS

| | | | |
|---|---|---|---|
| 2,254,587 | 9/1941 | Williams . | |
| 3,135,099 | 6/1994 | Holm . | |
| 3,451,342 | 6/1969 | Schwartzman . | |
| 3,987,632 | 10/1976 | Pereda . | |
| 4,676,289 | 6/1987 | Andonian | 62/47.1 |
| 4,838,034 | 6/1989 | Leonard et al. . | |
| 4,899,546 | 2/1990 | Eigenbadd | 62/50.2 |
| 5,111,666 | 5/1992 | Klok et al. | 62/50.2 |

FOREIGN PATENT DOCUMENTS 2273940 1/1976 France .

*Primary Examiner*—Ronald C. Capossei
*Attorney, Agent, or Firm*—Young & Thompson

[57] ABSTRACT

A self-contained device for the supply of energy to an apparatus (7) driven by gas under pressure, comprises a portable reservoir (1) of cryogenic liquid, and structure associated with the reservoir to withdraw and vaporize liquid from the reservoir and to send it to the apparatus (7). Two circuit portions ($2_1$, $2_2$) incorporate vaporizers ($5_1$, $5_2$) and are delimited between non-return valves ($4_1$, $4_2$) upstream and control valves ($6_1$, $6_2$) downstream. When open, the control valves drive the apparatus (7). The reservoir (1) is of the double wall type ($1_1$, $1_2$), at least one upstream part of the circuit portion ($2_1$, $2_2$) being disposed between these walls ($1_1$, $1_2$). The two circuit portions are in parallel ($2_1$, $2_2$) and the respective valves ($6_1$, $6_2$) are sequentially controlled by a control device (9, 12) which is sensitive to the pressure ($P_1$, $P_2$) prevailing in the circuit portions ($2_1$, $2_2$). Preferably, the apparatus (7) is a pump for supplying cryogenic liquid contained in the reservoir (1) to an installation for freezing food stuffs.

7 Claims, 1 Drawing Sheet

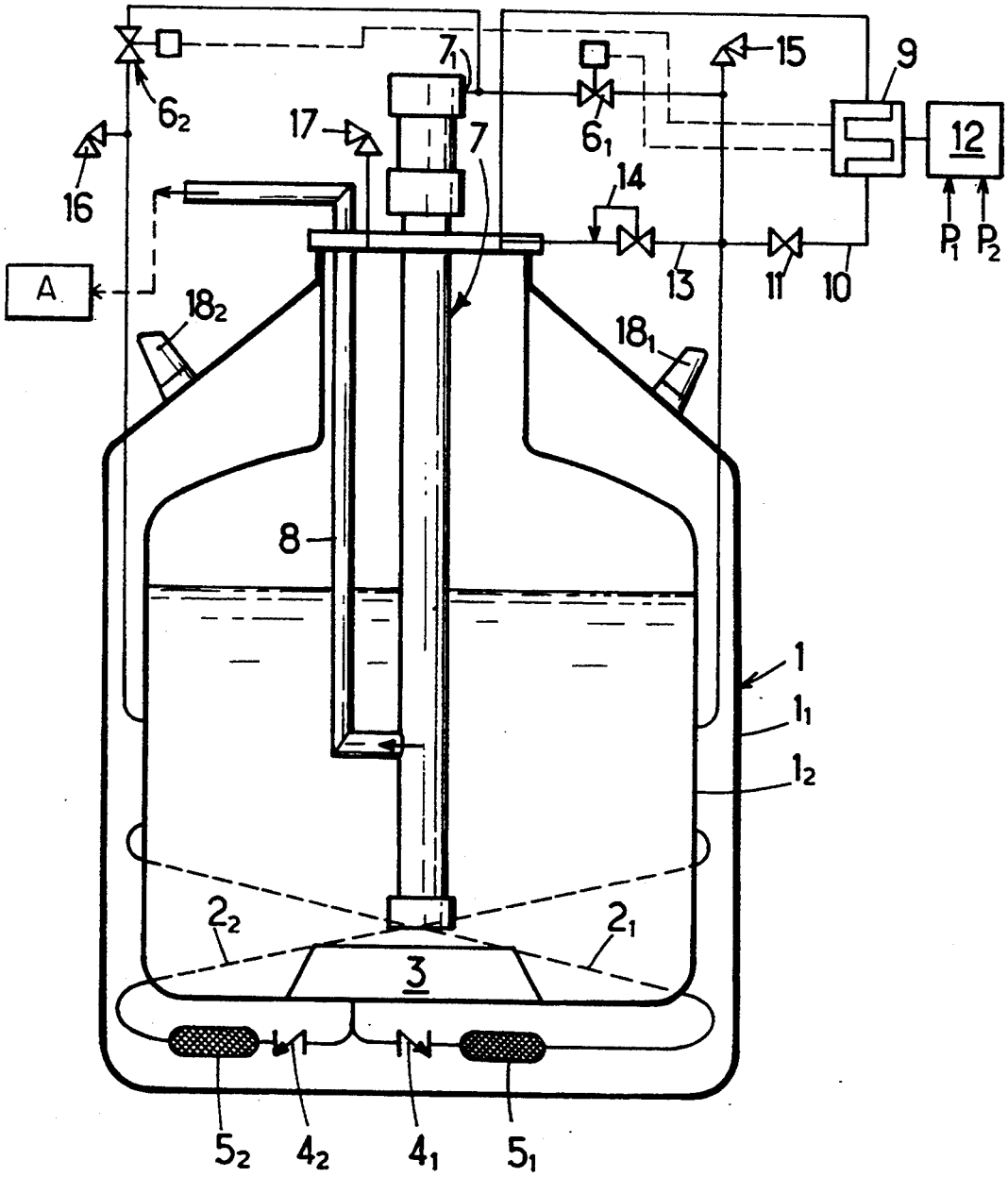
7₁
15
9
6₂
17
7
6₁
12
16
14
P₁ P₂
A
13
11
10
18₂
18₁
8
1
1₁
1₂
2₂
2₁
3
5₂
4₂
4₁
5₁

SELF-CONTAINED DEVICE FOR SUPPLYING WITH ENERGY AN APPARATUS ACTUATED BY A GAS UNDER PRESSURE AND ITS USE IN A FREEZING INSTALLATION

FIELD OF THE INVENTION

The present invention relates to a device for supplying with energy a pneumatic apparatus actuated by gas under pressure and, more particularly, to such a device permitting ensuring that such an apparatus will be self contained, of the type comprising a portable reservoir of the cryogenic liquid and means associated with the reservoir to withdraw and vaporize liquid from the reservoir and to send it to the utilizing apparatus.

BACKGROUND OF THE INVENTION

A device of this type is described in U.S. Pat. No. 4,838,034.

The present invention has for its object to provide an improved device of this type, of simplified and sturdy design, increased reliability, and which can be used in a number of various applications.

To do this, according to a characteristic of the invention, the withdrawal and vaporization means comprise at least one portion of the circuit incorporating a vaporization means and delimited between a non-return valve upstream and a control valve downstream.

The present invention also has for its object to provide a use of this device for the supply with cryogenic liquid of a freezing installation, particularly for freezing food products.

BRIEF DESCRIPTION OF THE DRAWINGS

Other characteristics and advantages of the present invention will become apparent from a reading of the description which follows and a study of the accompanying drawing, in which the single FIGURE represents schematically the supply device according to the invention.

DETAILED DESCRIPTION OF THE INVENTION

In this FIGURE, there is shown an axial cross section a reservoir 1 for cryogenic liquid, comprising conventionally a double wall $1_1$, $1_2$, the internal wall $1_2$ containing the cryogenic liquid, for example liquid nitrogen.

According to the invention, two serpentine conduits $2_1$ and $2_2$ are connected at 3 to the bottom of the wall $1_2$ of the reservoir to withdraw a cryogenic liquid contained in the reservoir. In each conduit $2_1$, $2_2$ are mounted, respectively, non-return valves $4_1$, $4_2$, evaporators $5_1$, $5_2$ and control valves $6_1$, $6_2$. The conduits $2_1$ and $2_2$ are thus mounted in parallel between the point of withdrawal 3 and the inlet $7_1$ for driving gas of an apparatus 7 of the class including pumps and pneumatic tools. In the embodiment shown in the drawing, given solely by way of example, this apparatus 7 is a pump partly immersed in the cryogenic liquid of the reservoir to send this liquid into a supply conduit 8 of an installation a utilizing such a liquid. Still by way of example, this installation a could be that described in European application No. 505 222 filed by the applicant, used for the freezing of food products.

Preferably, the conduits $2_1$ and $2_2$ and the associated members are disposed between the two walls $1_1$ and $1_2$ of the reservoir so as to constitute a transportable unit, if desired with the help of handles $18_1$, $18_2$. The conduits $2_1$ and $2_2$ serve to vaporize liquid withdrawn at 3 from this reservoir. It will be understood that the withdrawn liquid having cleared the non-return valve $4_1$ for example, flows into the evaporator $5_1$. This latter can be constituted, for example, by a chamber filled with metallic chips. The cryogenic liquid then flows in thin films on the surface of these chips thereby providing a large evaporation surface for liquid nitrogen.

The vaporized nitrogen then fills the serpentine from the non-return valve $4_1$ to the valve $6_1$, which in this instance is closed. The increasing pressure of the nitrogen on the valve prevents the latter from opening and this pressure can then continue to increase in the closed chamber delimited within the conduit between the valve $4_1$ and the closed valve $6_1$, until suitable pressure is established, for example six bars for the pump 7. When this pressure is reached, the control valve $6_1$ will open and the gas contained in the conduit $2_1$ supplies the motor portion of the pump 7 which supplies liquid nitrogen to the conduit 8.

It will be understood that the vaporization of the nitrogen in the conduit $2_1$ requires a certain time and that, after opening of the valves $6_1$, the pressure of the gaseous nitrogen supplied to the pump begins to fall, eventually to a value incompatible with the supply of the pump.

Thanks to the presence, according to the invention, of at least one other serpentine conduit such as $2_2$, a continuous supply of the pump 7 with driving gas can nevertheless be ensured, at a predetermined suitable pressure.

Thus, if when the valve $6_1$ is open to supply the pump, the valve $6_2$ is closed, the phenomena of withdrawal and of vaporization described above will take place in the serpentine conduit $2_2$, with formation in this conduit of gaseous nitrogen at an increasing pressure. By switching the supply of the pump to the conduit $2_2$ when the pressure in this conduit achieves a predetermined value consistent with the supply of the pump, while the pressure in the conduit $2_1$ falls below this value, there is ensured a continuous supply of the pump with the gas at a suitable pressure, by reversing periodically the condition of the control valves $6_1$, $6_2$.

The device according to the invention therefore comprises control means for the valves $6_1$, $6_2$. These means can comprise as shown in the drawing, a pneumatic reverser 9 supplied with gas under pressure by a line 10 drawing from the circuit $2_1$ for example with return to the reservoir above the free surface of the liquid nitrogen, a valve 11 that is manually closeable being disposed in this line. Upon placing the device according to the invention in operation, this valve is opened. The frequency of switching of the reverser 9 is adjusted by an electronic control 12, as a function of the time of vaporization of the nitrogen in each of the two circuits $2_1$, $2_2$. This control can also be supplied with signals $P_1$, $P_2$ representing the pressures prevailing in the circuits $2_1$, $2_2$, respectively, to adjust the frequency of the switching of the reverser so as to ensure the optimum continuity of supply of the pump 7 with driving gas, at a suitable predetermined pressure.

It will be noted incidentally that the device according to the invention also comprises a line 13 provided with a pressure regulator 14 and connected between the circuit $2_1$ for example, and the reservoir to maintain above the free surface of the liquid nitrogen a predetermined pressure, of for example 0.7 bar, so as to facilitate the flow of liquid nitrogen within the vaporization conduits. Moreover, safety valves 15, 16, 17 are mounted respectively in the circuits $2_1$, $2_2$ and on the reservoir.

It follows from the preceding description that the invention permits ensuring the complete autonomy of a source of supply of cryogenic liquid to a pump immersed in a reservoir. Of course, however, the invention is not limited to the embodiment described and shown which is given only by way of example. Thus, it is clear that the device according to the invention could also conveniently supply with driving gas an apparatus outside the reservoir. Similarly, there could be provided between the two walls of the reservoir more than two serpentine circuits to smooth further the driving gas pressure delivered by the device according to the invention.

What is claimed is:

1. A self-contained apparatus for supplying a flow of gas under pressure to a utilization tool, comprising a transportable container comprising an outer vessel and an inner vessel having a bottom wall for containing a cryogenic liquid and defining within the outer vessel an inner space, at least one gas supply circuit having an upstream circuit portion in fluid communication with an outlet in the bottom wall of the inner vessel and extending within the inner space, and a downstream circuit portion connectable to the utilization tool, the upstream circuit portion including a non-return valve, the downstream circuit portion comprising a control valve, the gas supply circuit incorporating a vaporizing section intermediate the non-return valve and the control valve.

2. The apparatus of claim 1, comprising two said gas supply circuits both connectable to the utilization tool, and control means for selectively opening and closing in alternance the control valves of said gas supply circuits.

3. The apparatus of claim 2, wherein said control means include a fluidic relay operated by pressurized fluid supplied by one of said gas supply circuits.

4. The apparatus of claim 2, wherein one of said gas supply circuits includes a branch which opens into the inner vessel for pressurizing it.

5. The apparatus of claim 2, wherein the utilization tool is a pump partly extending into the inner vessel and having a liquid delivery circuit extending out of the inner vessel for delivering liquid under pressure to a user station.

6. The apparatus of claim 5, wherein the user station is a station for freezing foodstuffs.

7. The apparatus of claim 1, wherein the utilization tool includes a driving turbine having an inlet connected to the at least one gas supply circuit.

* * * * *